US006059623A

United States Patent [19]

Kim et al.

[11] Patent Number: 6,059,623

[45] Date of Patent: May 9, 2000

[54] METHOD OF MANUFACTURING A TRIODE FIELD EMISSION DISPLAY DEVICE THAT MAINTAINS A CONSTANT DISTANCE BETWEEN A GRID AND A CATHODE ELECTRODE

[75] Inventors: Jae-Myung Kim, Suwon-shi; Kwi-Seok Choi, Songnam-shi; Sang-Jin Lee; Joong-Woo Nam, both of Suwon-shi, all of Rep. of Korea

[73] Assignee: Samsung Display Devices Co., Ltd., Rep. of Korea

[21] Appl. No.: 09/025,579

[22] Filed: Feb. 18, 1998

[30] Foreign Application Priority Data

Aug. 18, 1997 [KR] Rep. of Korea ..... 97-39232

[51] Int. Cl.[7] ..... H01J 9/00; H01J 9/12

[52] U.S. Cl. ..... 445/24; 445/49; 445/50

[58] Field of Search ..... 445/24, 49, 50

[56] References Cited

U.S. PATENT DOCUMENTS 5,382,867 1/1995 Maruo et al. ..... 313/309

5,430,348 7/1995 Kane et al. ..... 313/309

5,548,185 8/1996 Kumar et al. ..... 313/495

5,601,966 2/1997 Kumar et al. ..... 430/313

5,775,968 7/1998 Toyoda et al. ..... 445/24

*Primary Examiner*—Nimeshkumar D. Patel

*Assistant Examiner*—Michael J. Smith

*Attorney, Agent, or Firm*—Baker & McKenzie

[57] ABSTRACT

A method for manufacturing a triode field emission display device. First a predetermined pattern of cathode electrode is formed on a supporting substrate. A predetermined pattern of graphite layer is formed on the cathode electrode. An insulating layer is formed around the cathode electrode on the supporting substrate. A protecting resin layer is coated and hardened on the graphite layer. A predetermined pattern of grid is formed on the insulating layer. Finally, The protecting resin layer is thermally decomposed such that a distance between an inner circumference of the grid and an outer circumference of the graphite layer maintains constantly.

17 Claims, 3 Drawing Sheets

Fig.1 (This invention)
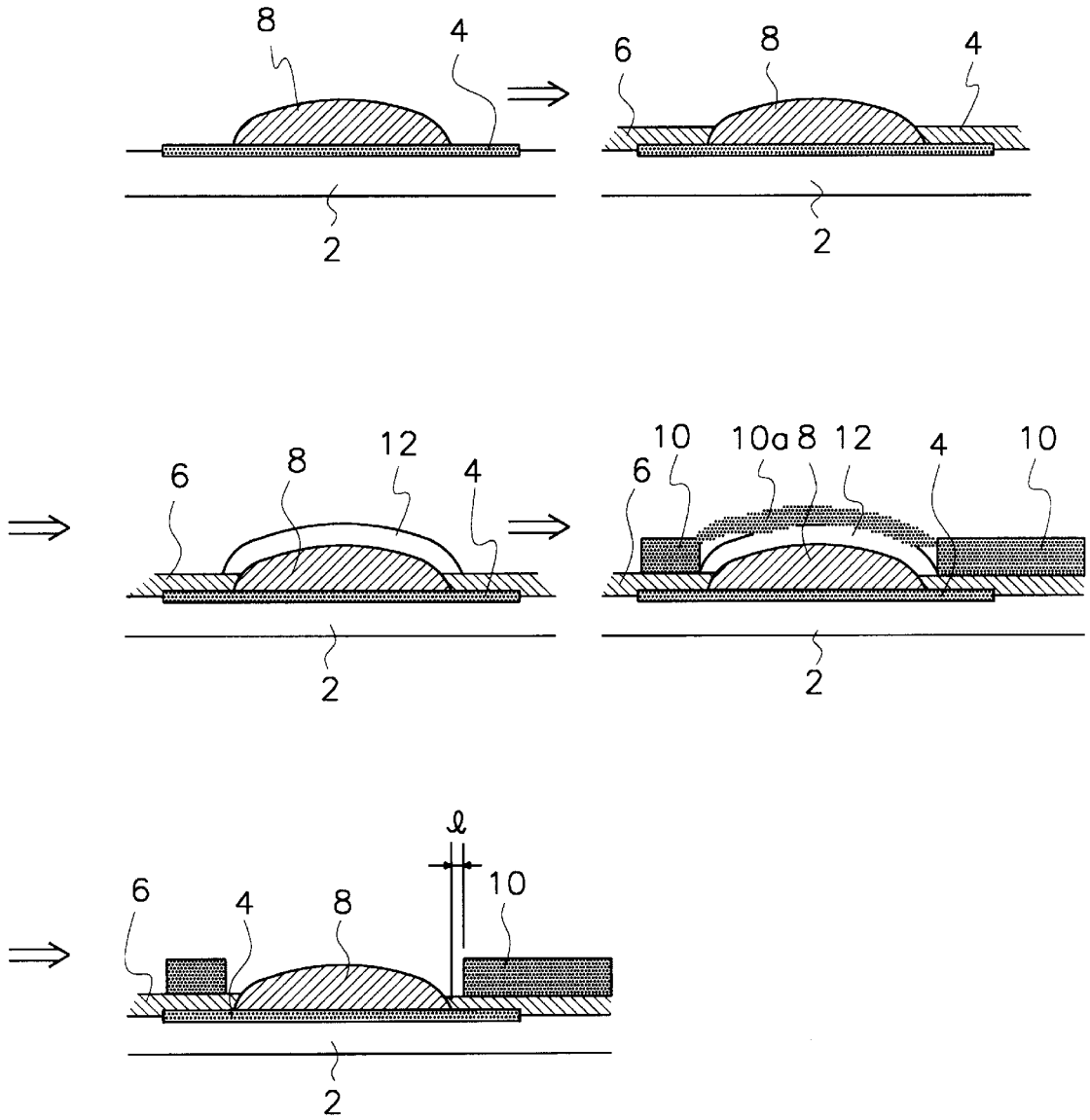

Fig.2 (This invention)
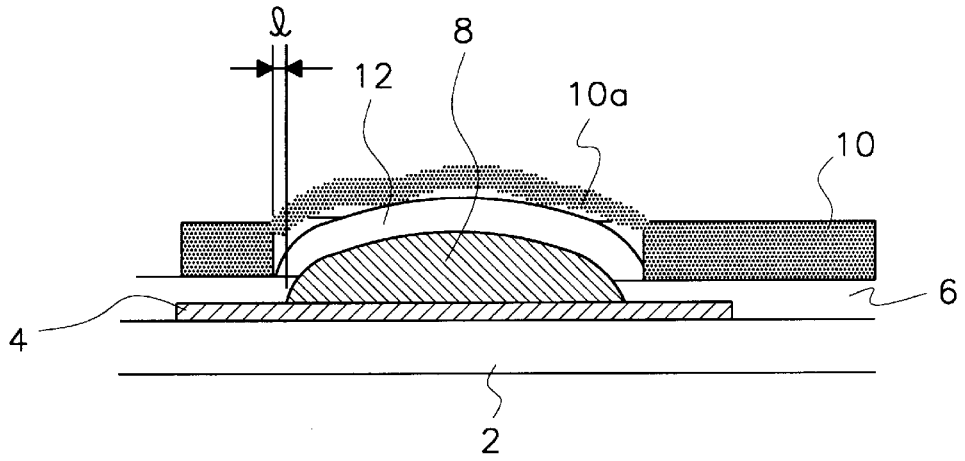
Fig.3 (Prior art)
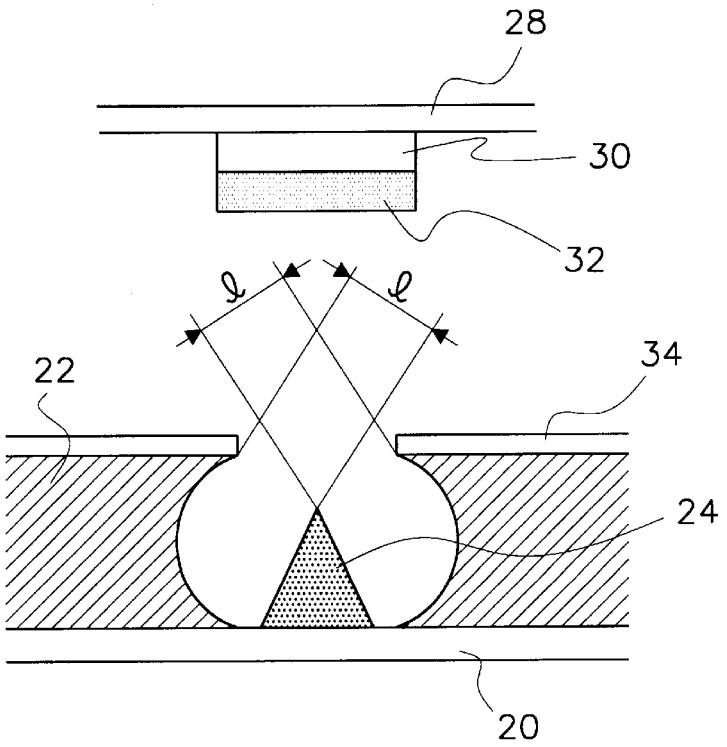

a = 1.54 Å a = 1.42 Å
b = 3.39 Å

METHOD OF MANUFACTURING A TRIODE FIELD EMISSION DISPLAY DEVICE THAT MAINTAINS A CONSTANT DISTANCE BETWEEN A GRID AND A CATHODE ELECTRODE

FIELD OF THE INVENTION

The present invention relates to a triode field emission display device and an improved technique for manufacturing the same.

BACKGROUND OF THE INVENTION

A field emission display device typically includes a pair of substrates which are maintained in a spaced apart, yet parallel relationship with one another. A plurality of cathodes and phosphors are disposed in a predetermined pattern upon the inner surface of one of the substrates.

In practice, electron emission is realized by Schottky effect generated by providing very high electric field between cathode and anode. Such emitted electrons strike phosphors to excite light from the display device.

The field emission display device is classified into two types. One is a diode type having an anode and a cathode, and the other is a triode type having a grid disposed between the anode and cathode. The field emission display is appropriate to apply in a large sized display and has an advantage of lowering electric power consumption. The contrast and brightness of the field emission display depend on the amount of electrons emitted from the cathode. In order to assure the large amount of electron emission, the cathode is designed to have an emitting surface area as large as possible by providing prominence and depressions.

To form the cathode on a supporting substrate, a metallic thin layer with high melting point selected from the group consisting of tungsten and molybdenum is first applied on the supporting substrate and is then etched by a laser abrasion process to have a sharp point tip. However, since this process requires a highly accurate exposure and etching technique, it is not appropriate to apply this process in making a display having a large size screen.

That is, as shown in FIG. 3, a cathode electrode 24 having a sharp point tip is formed on a supporting substrate 20 to be enclosed by an insulating layer 22. The cathode electrode is disposed opposing a phosphor 32 applied on an anode electrode 30 formed on a front substrate 28. A grid 34 is formed on the insulating layer 22 to control electrons emitted from the cathode electrode 24.

In the above described convention field emission display device, since the sharp point tip is easily damaged from a shock generated when an arc is generated, the life span of the display is reduced. The sharp point tip requires high operating voltage to emit electron.

In addition, since it is very difficult to maintain a distance between the inner circumference of the grid 34 and a top sharp point of the cathode electrode, luminance difference may occurs on a screen.

In addition, U.S. Pat. No. 5,430,348 to Robert C. Kane discloses a field emission display comprising a diamond cathode coated with an inversion layer. U.S. Pat. Nos. 5,548,185 and 5,601,966 to Nalin Kumar disclose a field emission display device using an amorphic diamond film. U.S. Pat. No. 5,382,867 to Maruo discloses a field emission display device comprising a cathode having a sawtooth-shaped surface which allows the display device to operate at low voltage. However, his still requires a high accurate etching process.

Generally, the diamond is well known as the most stable material, the principal ingredient of which is carbon.

As shown in FIG. 4, the diamond has a tetragonal crystal structure having hexagon (111) surface.

A disconnected end portion of the diamond is used as a passage for emitting electron. That is, when doping boron or nitrogen on the surfaces (111), since negative electron affinity phenomenon occurs, energy level of a conduction band becomes higher than that of a free electron, allowing a self-electron emission and low-voltage operation.

However, to make the cathode using diamond, the highly precise etching process is still required and increase the manufacturing costs.

Therefore, instead of the diamond, a material, a principal ingredient of which is graphite has been considered in the present invention.

As shown in FIG. 5, the graphite has a crystal structure similar to that of the diamond. That is, the crystal structure of the graphite is comprised of a plurality of hexagon surfaces (0001) which is similar to those of diamond (111) surface. However, the surfaces (0001) have a powerful double bond structure but a weak vanderwaals bond between surfaces, so have a strong anisotropy characteristics. The thermal and electric conductibilities are good on the surfaces (0001) but not in a vertical direction of the surfaces (0001). Since the coupling state between the surfaces (0001) is weak, the structure is easily broken.

However, because the corners of the surfaces (0001) are in an intensive covalent bond state, the corners can be used as an electron emission tip. Furthermore, when the graphite is broken by outer force, the broken surface provides a newly formed surfaces (0001), maintaining the electron emission quality. In addition, since the graphite inherently includes nitrogen impurities, the negative electron affinity can be generated without going through a specific process such that a low voltage operation can be expected.

However, in case of a triode field emission display device, the difficulty in constantly maintaining a distance between the inner circumference of the grid and a top sharp point of the cathode electrode still remains.

SUMMARY OF THE INVENTION

The present invention has been made in an effort to solve the above described problem.

Therefore, it is an object of the present invention to provide a method of manufacturing a triode field emission display device, which can constantly maintain a distance between a grid and a cathode electrode.

To achieve the above object, the present invention provides a method for manufacturing a triode field emission display device, comprising the steps of forming a predetermined pattern of cathode electrode on a supporting substrate, forming a predetermined pattern of graphite layer on the cathode electrode, forming an insulating layer around the cathode electrode on the supporting substrate, coating and hardening a protecting resin layer on the graphite layer, forming a predetermined pattern of grid on the insulating layer, and thermally decomposing the protecting resin layer such that a distance between an inner circumference of the grid and an outer circumference of the graphite layer maintains constantly.

Preferably, an ultraviolet ray hardener is added to the protecting resin layer.

Further preferably, a hardener which reacts with organic binder contained in graphite paste for the graphite layer is added to the protecting resin layer.

Preferably, an ultraviolet ray hardener is added to graphite paste for the graphite layer, and negative photosensitive material is added to the protecting resin layer.

BRIEF DESCRIPTION OF THE DRAWINGS

The foregoing and other objects and advantages of the present invention will be better understood from the following detailed description when viewed in conjunction with the attached drawings, in which:

FIG. 1 is a process diagram illustrating a method for preferred embodiment of the present invention;

FIG. 2 is a sectional view illustrating a process for forming a graphite layer according to a preferred embodiment of the present invention;

FIG. 3 is a schematic side cross-sectional view illustrating a covnventional field emission display device.

DETAILED DESCRIPTION OF THE INVENTION

Figure 4:
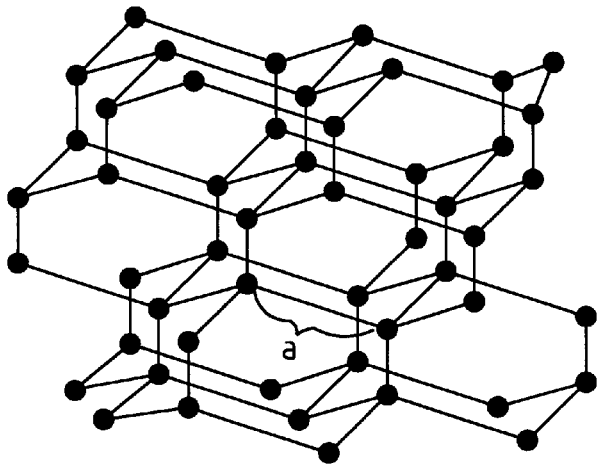
Fig.4 (Prior art)
FIG. 4 is a view illustrating a crystal structure of diamond.
Figure 5:
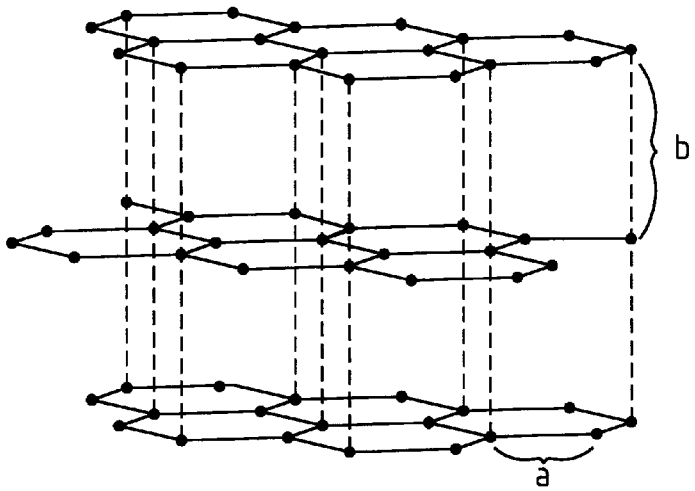
Fig.5 (Prior art)
FIG. 5 is a view illustrating a crystal structure of graphite.

Referring first to FIG. 1, there is shown a process diagram for manufacturing a triode field emission display device according to a preferred embodiment of the present invention.

First, a predetermined pattern of cathode electrode 4 is formed on a supporting substrate 2. The cathode electrode 4 is formed having a stripe shape through a screen printing process using silver paste or a sputtering process using indium tin oxide (ITO). A dot pattern of graphite layer 8 is formed on the cathode electrode 4. The graphite layer 8 is formed through printing and heat-treatment processes using paste consisting of graphite powder or graphite fibers. An insulating layer 6 is applied on the supporting substrate 2 around each dot of the graphite layer 8. The insulating layer 6 is not applied on the upper surface of each dot of the graphite layer 8. The insulating layer 6 is made through a printing process using glass paste. A dot pattern of protecting resin layer 12 is applied on the graphite layer 8 such that each dot of the protecting resin layer 12 covers each dot of the graphite layer 8. The protect resin layer 12 is formed through a printing process using organic paste. The protect resin layer 12 is then dried to be fixed on the graphite layer 8.

The organic paste is selected from the group consisting of cellulose resin or acrylic resin.

After forming the protecting resin layer 12, a pattern of grid 10 is formed on the insulating layer 6 through a sputtering process using conductive metal such as silver. In the present invention, since an unnecessary layer 10*a* may be applied on the protecting resin layer 12 during the sputtering process for forming the grid 10, accurate sputtering process is not required.

The unnecessary layer 10*a* is removed by thermally decomposing the protecting resin layer 12 through a calcinating process, which will be described below. As shown in FIG. 2, a dot of the protecting layer 12 is formed having a diameter larger than that of a dot of graphite layer 8. That is, the radial length of a portion of the dot of the protecting layer 12, which extends out of the outer edge of the dot of the graphite layer 8, are constant. The radial length becomes a distance "λ" between the outer circumference of the dot of the graphite layer 8 and the inner circumference of the grid 10.

After the grid 10 is formed through the sputtering process, the supporting substrat 2 is calcinated under a temperature of 500° C. During this calcination, the protecting resin layer 12 supporting the unnecessary layer 10*a* is thermally decomposed, causing the unnecessary layer 10*a* to be removed. That is, the unnecessary layer 10*a* is removed during the calcination process or through an air brushing process after the calcination process, thereby obtaining the supporting substrate 2 on which the inner circumference of the grid 10 is uniformly spaced away from the outer circumference of the dot of the graphite layer 8 by the distance "λ" as shown in FIG. 1.

In the above described method of the present invention, a hardener which reacts with organic binder contained in the graphite paste for the graphite layer 8 can be added to the protecting resin layer 12.

In this case, since hardening reaction occurs between the graphite layer 8 and the protecting resin layer 12, the protecting resin layer 12 can be stable applied on the graphite layer 8.

In addition, an ultraviolet ray hardener may be added to the graphite paste for the graphite layer 8, and negative photosensitive material is added to the protecting resin layer 12. In this case, the graphite layer 8 is exposed to an ultraviolet ray to be hardened, and the protecting resin layer 12 is etched such that the outer circumference of each dot of the protecting resin layer 12 has the same center point of that of each dot of the graphite layer 8. After this, the grids 10 is applied through the sputtering process and the protecting resin layer 12 is thermally decomposed, thereby obtaining the supporting substrate 2.

In this method, since the protecting resin layer 12 is defined by exposing portion, the protecting resin layer 12 is concentrically formed on the dot of the graphite layer 8. In addition, since the graphite layer 8 is hardened by the ultraviolet ray, it is not damaged during the etching process.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A method for manufacturing a triode field emission display device, comprising the steps of:

forming a predetermined pattern of cathode electrode on a supporting substrate;

forming a predetermined pattern of graphite layer on the cathode electrode;

forming an insulating layer around the cathode electrode on the supporting substrate;

coating and hardening a protecting resin layer on the graphite layer;

forming a predetermined pattern of grid on the insulating layer;

thermally decomposing the protecting resin layer such that a distance between an inner circumference of the grid and an outer circumference of the graphite layer is maintained constant.

2. A method of claim 1, wherein an ultraviolet ray hardener is added to he protecting resin layer.

3. A method of claim 1, wherein a hardener which reacts with organic binder contained in graphite paste for the graphite layer is added to the protecting resin layer.

4. A method of claim 1, wherein an ultraviolet ray hardener is added to graphite paste for the graphite layer, and negative photosensitive material is added to the protecting resin layer.

5. A method of manufacturing a triode field emission display device, comprising the steps of:

forming a pattern of cathode electrode on a supporting substrate;

forming a dot pattern of graphite layer on the cathode electrode;

applying an insulating layer on the supporting substrate around the each dot of the graphite layer;

forming a dot pattern of protecting resin layer on each dot of the graphite layer such that each dot of the protecting resin layer covers each dot of the graphite layer;

applying a grid on the supporting substrate to cover the protecting resin layer; and calcinating the supporting substrate to thermally decompose the protecting resin layer thereby removing a portion of the grid corresponding to each dot of the graphite layer.

6. A method of claim 5, wherein the cathode electrode is formed through a screen printing process using silver paste or a sputtering process using indium tin oxide.

7. A method of claim 5, wherein the graphite layer is formed through printing and heat-treatment processes using paste consisting of graphite power or graphite fibers.

8. A method of claim 5, wherein the insulating layer is made through a printing process using glass paste.

9. A method of claim 5, wherein the protect resin layer is formed through a printing process using organic paste.

10. A method of claim 9, wherein the organic paste is selected from the group consisting of cellulose resin and acrylic resin.

11. A method of claim 5, wherein the grid layer is formed through a sputtering process using conductive metal such as silver.

12. A method of claim 5, wherein a dot of protecting layer is formed having a diameter larger than that of a dot of graphite layer.

13. A method of claim 5, wherein the supporting substrate is calcinated under a temperature of about 500° C.

14. A method of claim 5, wherein an ultraviolet ray hardener is added to the protecting resin layer.

15. A method of claim 5, wherein a hardener which reacts with organic binder contained in graphite paste for the graphite layer is added to the protecting resin layer.

16. A method of claim 5, wherein an ultraviolet ray hardener is added to graphite paste for the graphite layer, and negative photosensitive material is added to the protecting resin layer.

17. A method of claim 5 further comprising the step of air-brushing the grid layer after the calcination step such that the portion of the grid layer corresponding to the graphite layer can be completely removed.

* * * * *